United States Patent [19]

Vatterott

[11] 4,427,355

[45] Jan. 24, 1984

[54] CORE PULLER ASSEMBLY

[75] Inventor: Oskar F. Vatterott, Pacific, Mo.

[73] Assignee: MCIBS, Inc., Clayton, Mo.

[21] Appl. No.: 325,096

[22] Filed: Nov. 27, 1981

[51] Int. Cl.[3] ..... B28B 7/00

[52] U.S. Cl. ..... 425/156; 425/167; 425/468

[58] Field of Search ..... 425/156, 167, 468, 414, 425/577, 219

[56] References Cited

U.S. PATENT DOCUMENTS

| | | | |
|---|---|---|---|
| 1,508,212 | 9/1924 | Bliss | 425/219 |
| 2,762,078 | 9/1957 | Haller | 425/414 |
| 3,604,075 | 9/1971 | Locke | 425/16 D |

*Primary Examiner*—John A. Parrish

*Attorney, Agent, or Firm*—Cohn, Powell & Hind

[57] ABSTRACT

This core puller assembly includes a bank of interconnected core puller units each having a cylinder, and a piston mounted within the cylinder and having a rearwardly extending connecting rod. Each core puller unit includes a core puller bar disposed in side-by-side relation below the cylinder and connected to the piston connecting rod for movement with said connecting rod. Each cylinder carries front and rear guide units receiving the core puller bar in sliding relation to guide the core puller bars into the mold assembly.

The cylinders are operated by a pneumatic air supply which includes a surge tank and a control system for controlling the supply of pressurized air to the cylinders.

18 Claims, 13 Drawing Figures

SIGNAL FROM BLOCK MACHINE

CORE PULLER ASSEMBLY

BACKGROUND OF THE INVENTION

This invention relates to core puller assemblies for molds used in conjunction with concrete block machines, and particularly to a rapid-acting, automatic multiple cylinder assembly.

High production concrete block machines operate rapidly and in those instances in which multiple blocks are molded with grooved lower faces it is necessary to provide multiple core bars which can be retracted from the molds at high speed to permit the newly molded blocks to be stripped from the molds and lowered by pallet onto a conveyor for transportation to storage.

In the past, core pullers have been utilized which provide a single, heavy duty hydraulic ram having a header actuated by the hydraulic ram and carrying multiple core bars which are inserted into, and retracted from, the molds. Such core pullers are heavy and bulky and cause serious space problems. In general, they are custom manufactured to suit a particular block machine and are not readily adapted for use with other block machines.

Machines of this type tend to be subject to guidance problems with respect to the elongate core bars and also to vibration problems resulting from intense vibration of the block machine during the molding process. Further, the use of a single hydraulically operated ram results in a relatively slow acting core puller assembly which interferes with normal production.

The present core puller solves these and other problems in a manner not disclosed in the known prior art.

SUMMARY OF THE INVENTION

This core puller assembly for block machine molds provides an automatic apparatus utilizing multiple cylinders to actuate guided core bars which enter the molds in timed response to the vibration cycle of the block machine.

The core puller assembly includes a plurality of core puller units each having a cylinder with a forward end and a rearward end; a piston mounted for sliding movement within the cylinder and having a rearwardly extending connecting rod; a core puller bar disposed in side-by-side relation and connected to the piston connecting rod, said bar having a forward portion movable into the mold assembly; and guide means carried by the cylinder, the guide means receiving the core puller bar in sliding relation to guide said bar into the mold assembly. The core puller assembly also includes support means interconnecting the core puller units together and aligning the core bars with the mold assembly; and drive means for supplying operating fluid to the cylinders.

It is an aspect of this invention to provide that each of the guide means includes a front guide unit and a rear guide unit, said front guide unit including resilient means to permit relative transverse movement between the associated core bar and the cylinder to take up vibration from the mold assembly.

It is a further aspect of this invention that the front guide unit includes a removable cartridge to permit the core bar to be subject to some vertical movement without damage.

It is a still further aspect of this invention to provide that the support means includes a front support member receiving the forward end of the cylinders in connected relation and side support members having alignment adjustment means.

It is yet another aspect of this invention to provide drive means which includes an electrically controlled pneumatic air supply including a surge tank to provide substantially even pressure to the cylinders, and control means including a solenoid controlled cycle air valve having timers actuated by the block machine to extend and retract the core puller bars.

It is another aspect of this invention to provide at least one of the core puller units with an adjustable stop disposed on the piston connector rod to predetermine the extent to which the core puller bars enter into the mold assembly.

Still another aspect of this invention is to provide at least one of the core puller units with a switch having a switch actuator mounted to the associated core puller bar to preclude stripping of the mold assembly until the switch is closed.

Another aspect of this invention is to provide front and rear guide units which include plastic inserts apertured to receive the core bars in sliding relation, the front insert having at least one flexible element providing resilient means to permit relative transverse movement between the core bar and the cylinder, and the rear guide unit including an insert apertured to receive the core bar in sliding relation.

In still another aspect of this invention each core bar unit cylinder includes a front end stop having a socketed portion and the piston includes a reduced forward portion received by the cylinder socketed portion in cushioned relation.

In yet another aspect of this invention each core bar unit cylinder includes a pressurized air receiving port at the front and rear end, and the piston includes a circumferentially disposed lubrication pad on its outer surface, and passage means is provided between the lubrication pad and the front air receiving port to provide pressurized air to the lubricating pad tending to exert radial pressure by said pad against the inside walls of the cylinder.

In still another aspect of this invention the component parts of the core puller assembly are connected to withstand vibration of the block machine and the core puller assembly is relatively lightweight and readily adapted for use with several different block machines. The core puller assembly is rapid acting and does not change the normal sequence of operation of the block machine thereby permitting high schedules to be maintained.

DESCRIPTION OF THE PREFERRED EMBODIMENT

Figures 1, 8:
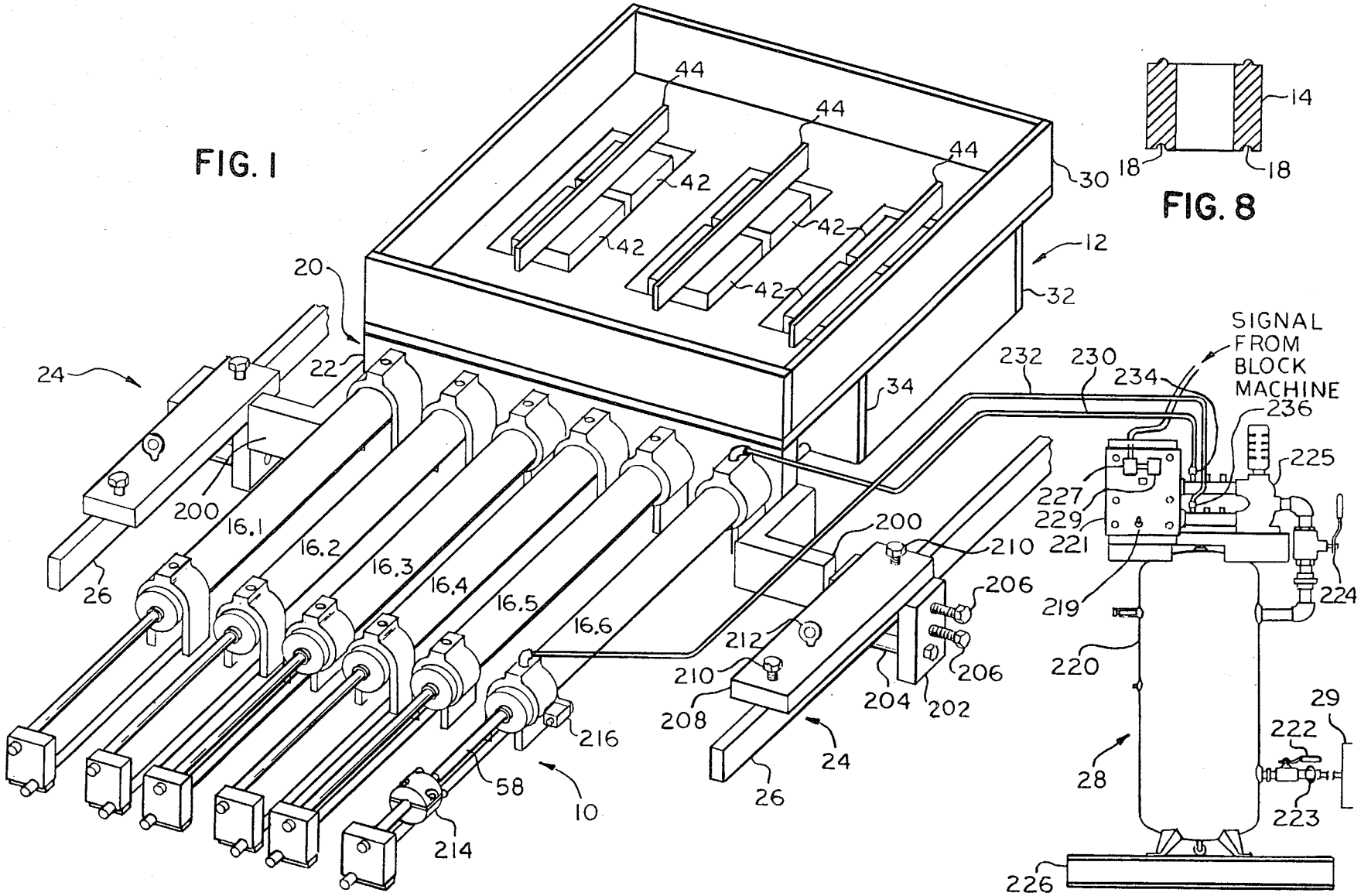
FIG. 1 is a perspective view of the core puller assembly as used in conjunction with a mold assembly.
FIG. 8 is a cross sectional view showing a typical ribbed and grooved block produced by the block machine.
Figure 13:
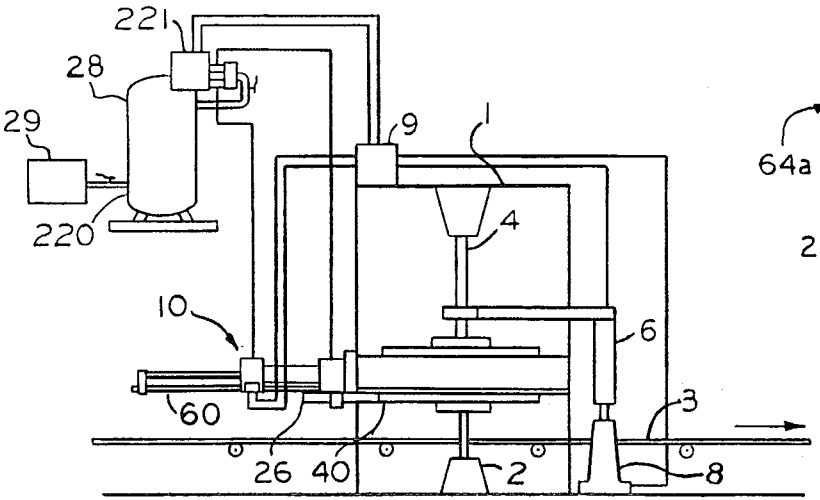
FIG. 13 is a schematic showing the block machine and core puller assembly.

Referring now by reference numerals to the drawings and first to FIG. 1, it will be understood that the core puller assembly generally indicated by numeral 10, is used in conjunction with a mold assembly 12 which, in the embodiment shown, forms part of a concrete block machine 1 shown schematically in FIG. 13 for producing grooved and ribbed concrete blocks 14 of the type shown in FIG. 8.

The core puller assembly 10 includes a plurality of core puller units 16.1 through 16.6 which are essentially similar to each other and differ only as necessary to suit the particular spacing of the semi-circular grooves 18 in the concrete block 14 as will be described.

The core puller assembly 10 includes a support assembly 20, constituting a support means and providing a front support member 22, by which the core puller assembly units 16.1 through 16.6 are interconnected, and side support members 24 extending outwardly from and connected to said front support member 22, as by welding, by which the core puller assembly 10 is mounted to the side arms 26 in adjustably aligned relation to the mold assembly 12 of the concrete block machine.

As shown in FIG. 1, in the embodiment shown, the core puller units 16.1 through 16.6 are pneumatically operated by a drive unit 28 constituting a controlled air supply which receives air from a compressor 29.

Figure 2:
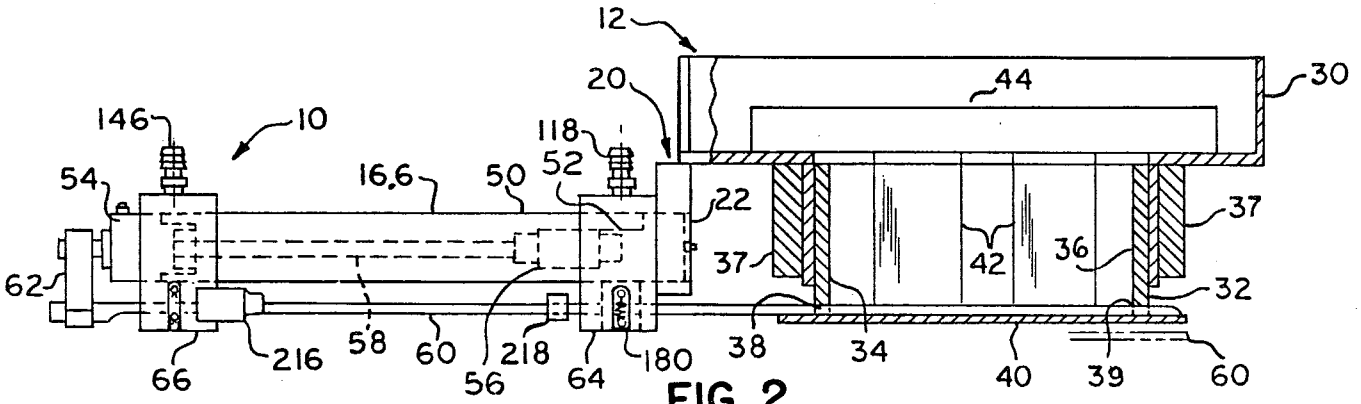
FIG. 2 is a side elevational view of the core puller assembly.

As best shown by reference to FIG. 2, the mold assembly 12 includes an upper mold portion 30, and a lower, cavity portion 32 having opposed front and rear liner walls 34 and 36, connected to the upper mold portion 30 by connection plates 37, and a movable pallet portion 40. Walls 34 and 36 include semi-circular grooves 38 and 39 for receiving core bars for forming the grooves 18 in the concrete blocks. The lower cavity portion 32 provides a plurality of cavities defined by two or more core blocks 42 which are held in place by core holder members 44.

Figure 3:
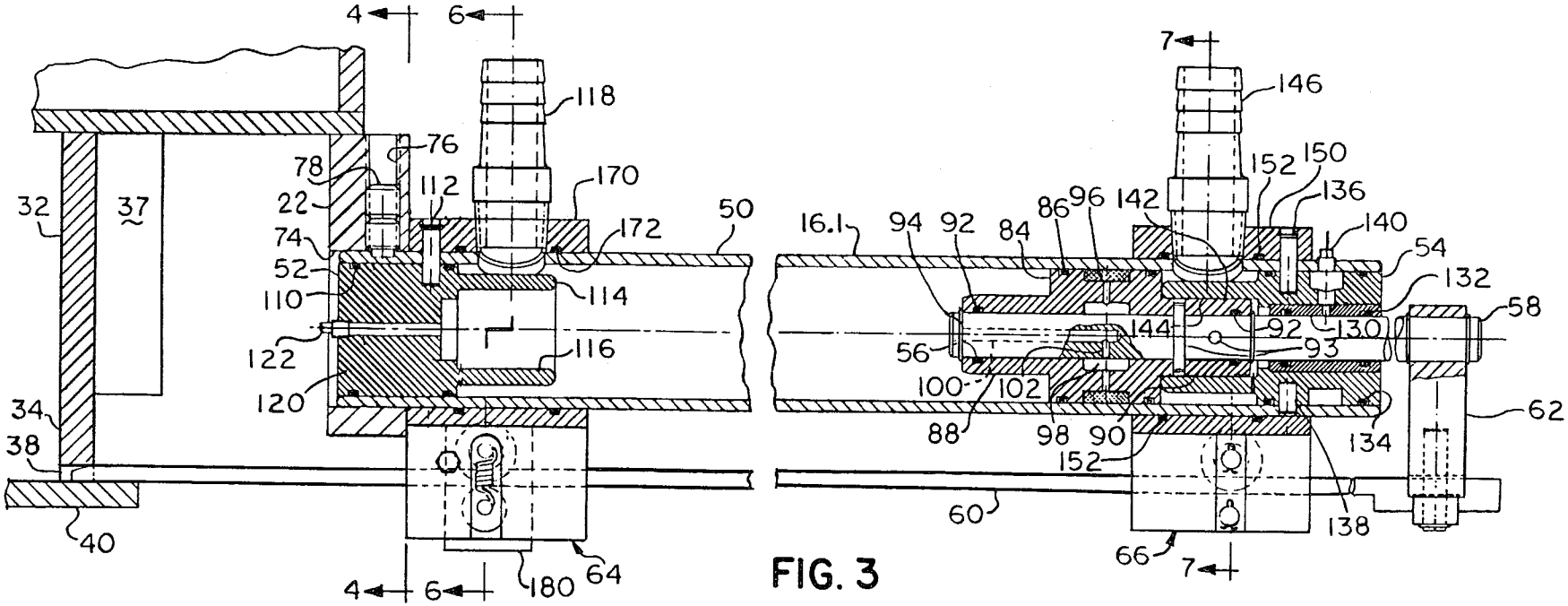
FIG. 3 is an enlarged longitudinal sectional view through a core puller unit.

The core puller units 16.1 through 16.6 are, as discussed above, substantially similar to each other and will be described more specifically with respect to unit 16.6. The units are best described by reference to FIGS. 2 through 7 and first to FIGS. 2 and 3. As shown in FIG. 2, core puller unit 16.6 includes a cylinder 50 having front and rear end stops 52 and 54, respectively, adapted to engage a piston member 56 which is slidingly movable between said end stops and which is of a lightweight material such as aluminum as compared with the other components of the core puller units which are mostly steel. The piston 56 includes an elongate connecting rod 58, which extends outwardly of the cylinder 50. An elongate core puller bar 60, of generally semi-circular configuration, is attached to the connecting rod 58 by means of a transverse connecting arm 62. The core puller bar 60 is disposed in side-by-side relation with the connecting rod 58 and moves reciprocatively with said connecting rod into and out of engagement with the semi-circular openings 38 and 39 in the mold assembly front and rear liner walls 34 and 36 respectively. Front and rear guide units 64 and 66, mounted to the cylinder 50, provide a guide means for the core puller rod 60 to ensure accurate alignment with the mold assembly openings 38. FIG. 2 shows the core puller rods 60 in an extended condition and FIG. 3 shows the core puller rods in a retracted position. FIG. 3 also shows the component parts of the core puller unit 16.6 and the front support member 22 in greater detail, as will now be described with reference to FIGS. 3 and 4.

Figure 4:
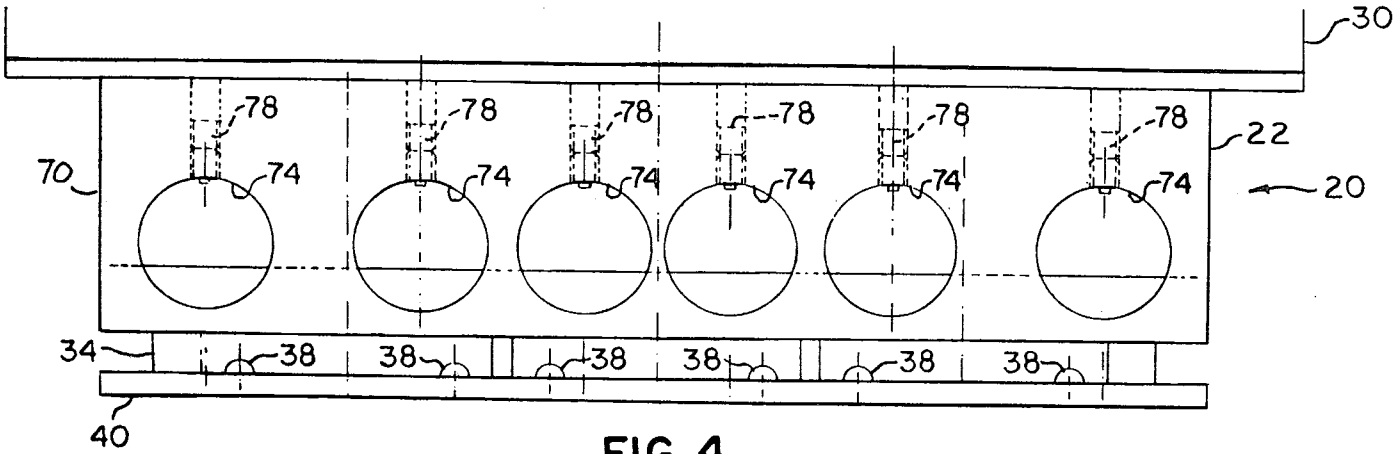
FIG. 4 is an end view of the support frame and mold assembly with the core puller cylinders removed, taken on line 4—4 of FIG. 3.
Figure 9:
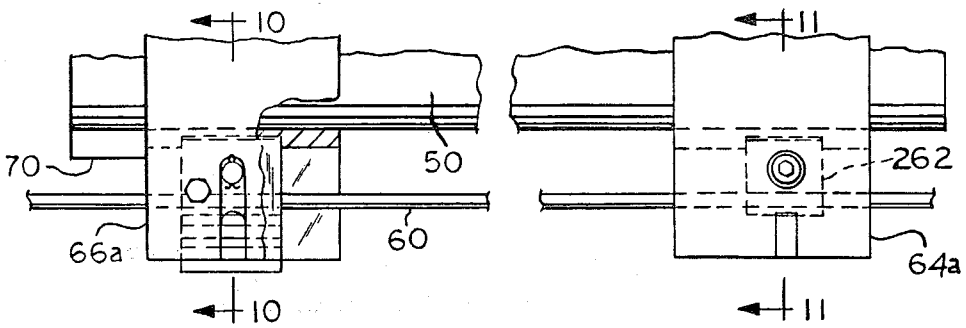
FIG. 9 is a fragmentary, longitudinal sectional view similar to FIG. 3 showing a modified core bar guide assembly.

The front support member 22 includes a vertical leg 70. As shown in FIG. 4, the vertical leg 70 is provided with a plurality of front openings 74, which receive associated core puller cylinders 50 in supporting relation, and a plurality of vertical openings 76, which receive a cylinder retaining screw and lock screw assembly 78 providing an anti-vibration connection by which the cylinders 50 are held in place.

The piston 56 includes an intermediate portion 84, exteriorly grooved to receive O-rings 86, and reduced front and rear portions 88 and 90 interiorly grooved to receive O-rings 92. The piston 56 is connected to the connecting rod 58 by means of transverse dowel pins 93 and locator retainer rings 94, said connecting rod being grooved adjacent each end of said piston to receive said rings. The piston 56 intermediate portion 84 is exteriorly circumferentially grooved at its mid-point to receive an annular lubricating pad 96 and is interiorly grooved to provide an annular lubricating reservoir 98. Lubricating fluid is supplied to the pad 96 by means of an axial passage 100 and communicating transverse passages 102 as will be described.

The front end stop 52 is exteriorly grooved to receive O-rings 110, and is held in place by a pin and retaining ring assembly 112. Stop 52 includes a reduced diameter portion 114 having a socket 116 receiving the piston end portion 88 in cushioned relation, a bleed passage 117 being provided between the socket 116 and the interior of the cylinder 50, said end stop and said piston cooperating to define an annular chamber receiving air from the air inlet connection 118, said air being charged with lubrication fluid. The air supplied under pressure from the air inlet connection 118 enters the relatively lightweight piston 56 by way of passages 100 and 102 and forces the lubricating pad 96 radially outward into contact with the interior surface of the cylinder 60 so that the pistons 56, in effect, floats on the lubricated pad. An axial passage 120 is connected to a lubrication plug point 122 so that an initial supply of lubricating fluid can be provided for the cylinder 50 prior to operation.

The rear end stop 54 includes a bushing 130 interiorly grooved to receive O-rings 132. The end stop 54 is exteriorly grooved to receive O-rings 134 and is held in place by a pin and retaining ring assembly 136, and a pin 138. A lubrication fitting 140 communicates with the piston connecting rod 58 by way of the apertured bushing 130. The end stop 54 includes a reduced diameter portion 142 having a socket 144, said end stop and piston cooperating to define an annular chamber receiving air from an air inlet connection 146.

Figure 6:
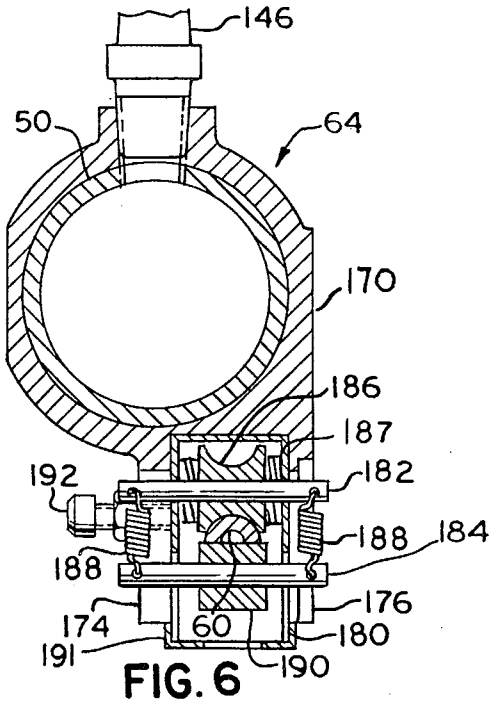
FIG. 6 is a cross-sectional view taken on line 6—6 of FIG. 3 showing the front guide unit.
Figure 7:
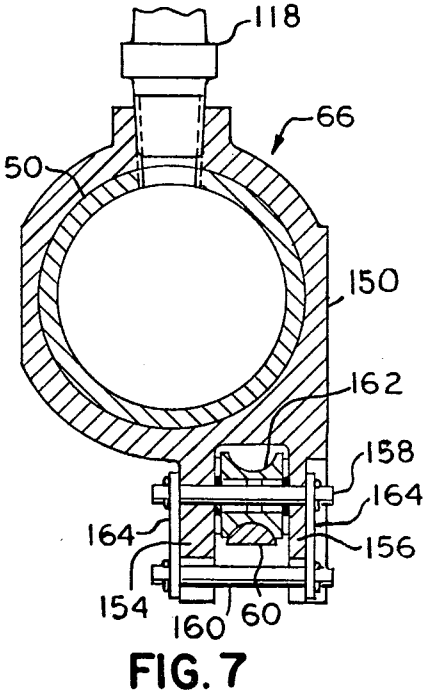
FIG. 7 is a cross sectional view taken on line 7—7 of FIG. 3 showing the rear guide unit.

The core puller front and rear guide units 64 and 66 are best understood by reference to FIGS. 3, 6 and 7. As shown in FIG. 3, the rear guide unit 66 includes a sleeve member 150 interiorly grooved to receive O-rings 152 and attached to the guide cylinder 50 by pin and retainer ring assembly 136. As best shown in FIG. 7, the sleeve member 150 includes a pair of spaced depending arms 154 and 156, apertured at the upper end and slotted at the lower end, to receive upper and lower shafts 158 and 160 respectively. Shaft 158 carries a freely rotatable guide roll 162 having a semi-circular rim configuration to receive the core puller rod 60. The shafts 158 and 160 are connected by retainer plates 164, held in place as by splits pins, so that the lower shaft 160 provides a keep means which precludes substantial downward movement of the core puller rod 60.

As shown in FIG. 3, the front guide unit 66 is similar to the rear guide unit 64 in that it includes a sleeve member 170 interiorly grooved to receive O-rings 172 and is attached to the cylinder 50 as by pin and retaining ring combination 112. As shown in FIG. 6, it is different from the front guide 66 in that spaced depending arms 174 and 176 receive a generally rectangular removable cartridge 180.

The cartridge 180 is apertured at the upper end and slotted at the lower end to receive upper and lower shafts 182 and 184 respectively. Shaft 182 carries a freely rotatable guide roller 186 having a semi-circular rim configuration to receive the core pulling rod 60 and the shaft includes spacer spring 187 at each side of the guide roller 186 and the cartridge 180. The shafts 182 and 184 are connected by tension springs 188 and at the lower shaft 184 carries a freely rotatable guide roller 190 having a flat rim configuration to receive the underside of the core puller rod 60. The depending arms 174 and 176 are slotted to receive the removable cartridge 180, and said cartridge is held in place by means of a retaining screw and lock nut assembly 192 received by arm 174. The assembly 192 is tightened to exert sufficient force to retain the guide cartridge 180 in place under normal operating conditions and the cartridge includes a lower access panel 191 which is welded, or otherwise attached, following assembly of the component parts.

Provision of spacer springs 187 and tension springs 188 provides resilient means permitting relative horizontal and vertical movement respectively of the core bars 60 transversely of the cylinders 50 resulting from vibration of the mold assembly 12.

Figure 10:
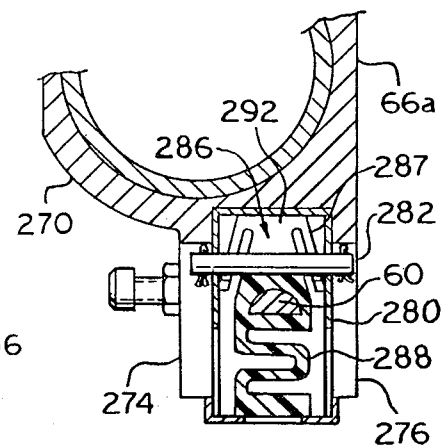
FIG. 10 is a cross-sectional view taken on line 10—10 of FIG. 9 showing the modified front guide unit.
Figure 11:
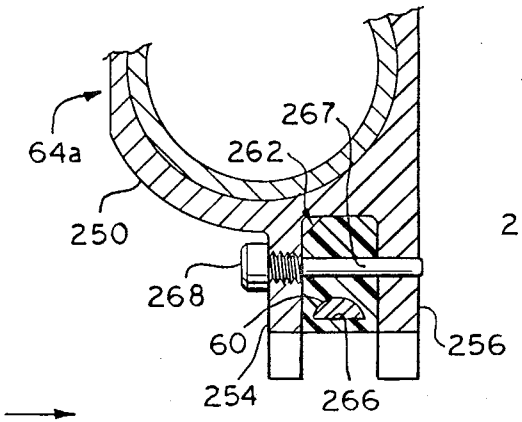
FIG. 11 is a cross sectional view taken on line 11—11 of FIG. 9 showing the modified rear guide unit.
Figure 12:
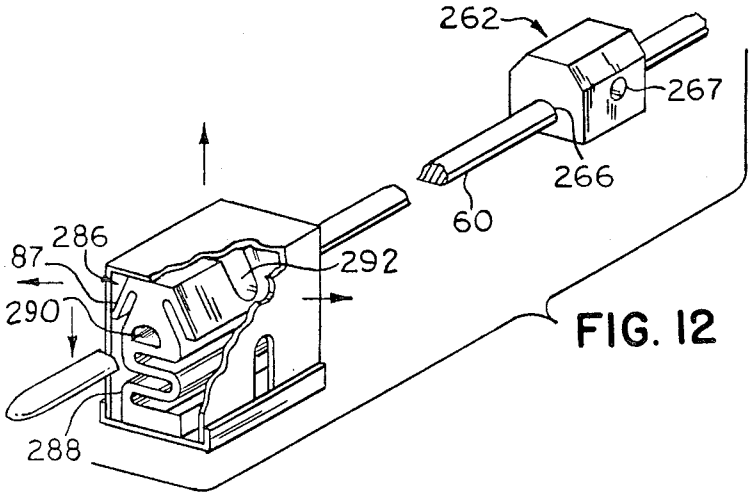
FIG. 12 is a perspective view showing details of the modified guide assembly.

A modified guide assembly is illustrated in FIGS. 10–12 which utilizes plastic inserts to perform the front and rear guide operation rather than roller assemblies.

The modified rear guide unit **64*a* is similar to the front guide unit 64 in that a sleeve 250 is provided which includes a pair of spaced depending arms 254 and 256 apertured at the upper end and slotted at the lower end. As shown in FIG. 11 the modified rear guide units 64*a* distinguishes from rear guide unit 64 in that a plastic insert 262 is provided in lieu of a roller assembly. The plastic insert 262, clearly shown in FIGS. 11 and 12, includes a longitudinal passage 266 at the lower end receiving the core bar 60 in sliding relation, and a transverse passage 267 at the upper end receiving an insert retaining screw 268 which is also received by spaced apertured arms 254 and 256 to hold the insert 262** in place.

The modified front guide unit **66*a* is similar to the front guide unit 66 in that a sleeve member 270 is provided having spaced depending arms 274 and 276 which receive a removable cartridge 280. The cartridge 280 is apertured at the upper end and slotted at the lower end. As shown in FIG. 10, the modified front guide unit 66*a* distinguishes from front guide unit 66 in that a plastic insert 286 is provided in lieu of a roller assembly. The plastic insert 286 includes integrally formed flexible side elements 287 at the upper end, and an integrally formed flexible bellows element 288 at the lower end. The insert 286 also includes a longitudinal passage 290 receiving the core bar 60 in sliding relation and a transverse, intermediate slot 292 at the upper end receiving an insert retaining pin 282 held in place as by split pins. The depending arms 274 and 276 are slotted to receive the removable cartridge 280, and said cartridge is held in place by means of a retaining screw and lock nut assembly 292 received by arm 274 to retain the guide cartridge 280** in place under normal operating conditions.

The provision of flexible side elements 287 and the flexible bellows elements 288 provide resilient means permitting relative horizontal and vertical movement of the core bars 60, transversely of the cylinders 50, resulting from mold assembly vibration.

Figure 5:
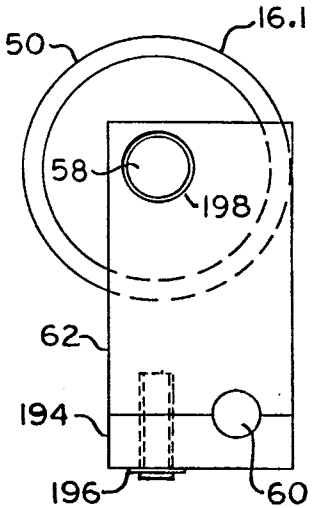
FIG. 5 is an end view of a core puller unit showing the connection arm between a piston connecting rod and a core bar.

As described above, the core units 16.1 through 16.6 are essentially substantially similar. However, in order to suit the multiple groove arrangement in the mold assembly 12 the core puller bars 60 and associated guide units 64 and 66 are offset relative to the axis of associated pistons. This arrangement is clearly shown in FIGS. 1 and 5 and by reference to FIG. 4 which shows the relationship between the cylinder receiving openings 74 and the core bar groove openings 38 and 29. As shown in FIG. 5, the transverse arm 62, which interconnects the piston connecting rod 58 to the end of the core puller bar 60 includes a key plate 194 which is notched to interfit a corresponding notch provided in the circular end of the core puller bar 60. The key plate 194 includes a set screw and retaining ring assembly 196 by which the core bar 60 is held in place. As also shown in FIG. 5, the piston connecting rod 58 is held in place by retainer rings 198.

The side support members 24, by which the core puller assembly 10 is supported on the side arms 26 of the block machine 1 are shown in FIG. 1. As shown, the side support members 24 include angle members 200 attached at one end to the front support member 22, as by welding, and having opposed vertical clamping plates 202 attached to the other end of said angle members 200. The clamping plates 202 having a spacer bar 204 extending therebetween and are provided with opposed pairs of clamping bolts 206 engageable with the block machine arms 26. A horizontal plate 208 is welded, or otherwise connected, between the upper ends of the vertical clamping plates 202, said plate 208 including a pair of elevation adjusting bolts 210 and a lifting eye 212.

As also shown in FIG. 1, the length of the stroke of a particular piston 56 and therefore of the associated core bar 60 can be controlled by a resilient short stop 214 adjustably mounted to the connecting rod 58 of one of the core puller units such as core puller unit 16.6. This predetermines the extent to which the core bar 60 enters the mold assembly 12 and permits a partial groove to be formed in those blocks in which a full length groove is not required. Also mounted to said unit 16.6 as shown in FIGS. 1 and 2 is a safety switch 216 which is provided for shutting off the system, and is actuated by a safety switch actuator 218 mounted to the core bar 60 of the unit 16.6.

Block machines of the type with which the core puller assembly 10 is used are shown schematically in FIGS. 13. The block machine 1 is supplied with pallets 40 by a conveyor 3. The pallets 40 are raised into position, as by a lower lift unit 2. The molds are filled as by a metering chute (not shown) and an upper stripper head unit 4, having a movable height pin 6 connected thereto is lowered into position until the height pin 6 engages a relatively fixed height pin 8. The height pins 6 and 8 determine the height of the blocks 18 and also provide electrical contacts, which close to initiate termination of the vibration cycle and also actuate the stripping action of the head unit 4 by way of the delay timer 9. The delay timer 9 also sends a signal to the core assembly 10 so that the core bars 60 are retracted prior to the stripping action. The safety switch actuator 218 mounted to the core bar of unit 16.6 is incorporated into the block machine circuitry to preclude stripping of the mold assembly until the switch is closed.

The drive unit 28 shown in FIG. 1 constitutes a drive means providing a 110 v AC electrically controlled pneumatic air supply which includes a surge tank 220 so that even air pressure is maintained during the operating strokes of the core puller assembly 10. The surge tank 220 is provided with an air inlet valve 222 receiving air from the compressor 29 and a main shut-off valve 224. The drive unit control means, indicated by numeral 221, includes a fast acting, solenoid controlled, cycle control air valve 225. Timers 227 and 229 of different duration are used, actuated by a signal from a delay timer 9 on the block machine 1, to retract and extend the core puller bars 60. The drive unit 28 is mounted to a base 226 of spaced channels to facilitate movement of the unit by fork lift. Switch 219 turns the assembly 10 on.

It is thought that the structural features and functional advantages of this core puller assembly have become fully apparent from the foregoing description of parts but for completeness of disclosure the operation of the assembly will be briefly described.

The core puller assembly 10, with the core puller rods 60 removed, and with the support assembly spacers 204 removed, is lifted into position by means of a chain (not shown) utilizing eyebolts 212. The side support members 24 are then lowered into position until they are seated on the machine side arms 26, at which time the spacers 204 are replaced. Following this, the core puller assembly 10 is aligned with the mold assembly 12 by means of adjustment bolts 208 and 210 and connected to it by means of connection bolts 82, see FIG. 3.

At this time, the core puller rods 60 can be placed in position in the guide units 64 and 66. When this is done the core bars 60 can be slid into place within the grooves 38 of the mold assembly front liner wall 34 but slightly below the grooves 39 of the rear liner wall 36 and final adjustment made of the core puller assembly 10. As shown in FIG. 2, the core bars 60 should fit the front liner plate 34 closely but the remote end of the core bar 60 should have a vertical clearance of between one half-inch (½") to two and one-half inches (2½") at the rear liner 38 as shown in phantom outline in FIG. 2. This is achieved by appropriate longitudinal tilting of the core puller assembly 10. The final positioning of the core bars 60 is accomplished by the upward movement of the pallet 40. This arrangement facilitates accurate positioning of the core bars 60 without the exact alignment which would otherwise be necessary to avoid engagement between the core bars 60 and the rear liner 36. When alignment is completed, the piston connecting rods 58 can be pulled out and each core bar 60 connected to its associated transverse arm 62 by permitting the key plate 194, FIG. 5, to enter the keyway and then tightening the locking bolt 196.

The air hoses 230 and 232 can be connected between the air cylinder nipples 118 and 146, and the corresponding nipples 234 and 236 on the drive unit 28. When this is done the core puller assembly 10 can be cycled manually to ensure that when fully retracted, as shown in FIG. 3, the core bars 60 partially enter the openings 38 of the mold front liner wall 34, but are not protruding into the mold cavity.

The sequence of operation begins with the core bars 60 fully extended into the mold assembly liner plates 32 and 34 as shown in FIG. 2. When the core bars 60 are in place in the mold assembly 12, the pallet member 40 is moved into position below said bars. Following this, the mold assembly 12 fills with concrete and vibration of the block machine is commenced. Engagement of the height pins 6 and 8 initiates termination of vibration. Prior to the complete termination of vibration the block machine delay timer 9, actuated by engagement of the height pins, sends a signal to the drive unit timers 227 and 229 which actuate the air valve 225. The core bars 60 are retracted, when timer 227 times out, by supplying air to the cylinder front air inlets 118 at the same time as the vibration is completed since stripping action begins very shortly, about four-tenths (4/10) of a second after completion of vibration. The completed blocks 14 are lowered with the pallet member 40 and transported by the conveyor 3 to storage. When timer 229 times out air is supplied to the cylinder rear air inlets 146 and the core bars 60 re-enter the mold assembly liner walls shortly before another pallet member 40 is returned into position for the next cycle.

The use of pin and retaining ring type connections for the core puller assembly 10 components permits assembly to withstand vibration of the block machine. In addition, the provision of front and rear guides 64 (64*a*) and 66 (66*a*) permits the core bars to have both horizontal and vertical movement capability, thereby compensating for movement of the mold assembly 12 during the vibration of the block machine. The provision of the removable cartridge 180 in the front guide unit 64, which is held in place by a retaining screw assembly 192 permits the core bars 60 to flex downwardly without serious damage if an excessive load is encountered by the bars by removal of the cartridge.

The incorporation of the surge tank 220 into the drive unit 28 and the provision of an air inlet valve 222 and pressure gauge 223 permits correct inlet pressure to be checked and an even pressure to be maintained during the cycling of the core puller assembly 10. Air from the surge tank 220 is transferred to the solenoid valve, which receives its signal from the control panel 221 by way of the block machine delay timer 9. Vibration cycles are short, commonly only three to four (3–4) seconds and core bars must be removed immediately to avoid adhesion to the concrete.

I claim as my invention:

1. A core puller assembly for a block machine mold assembly comprising:

(a) a plurality of core puller units each including:

1. a cylinder having a forward end and a rearward end,
2. a piston mounted for sliding movement within the cylinder and having a rearwardly extending connecting rod,
3. a core puller bar disposed in side-by-side relation with the connecting rod, said bar including a radially offset from the axis of the forward portion cylinder movable alongside the cylinder and into the mold assembly and a rearward portion,
4. connecting means between the core puller bar and the connecting rod, and
5. guide means carried by the cylinder, said guide means receiving the core puller bar in sliding relation to guide said core puller bar into the mold assembly, (b) support means interconnecting the core puller units together and aligning the core bars with the mold assembly, and (c) drive means supplying fluid to the cylinders.

2. A core puller assembly as defined in claim 1, in which:

(d) each of the guide means includes a front guide unit and a rear guide unit, said front guide unit including resilient means to permit relative transverse movement between the associated core bar and cylinder.

3. A core puller assembly as defined in claim 1, in which:

(d) each of the guide means includes a front guide unit and a rear guide unit, said front guide unit including a removable cartridge permitting transverse movement of the associated core puller bar.

4. A core puller assembly as defined in claim 1, in which:

(d) the support means includes a front support member receiving the forward end of the cylinders in connected relation, (e) the support means including side support members operatively connected to the front support member and having alignment adjustment means.

5. A core puller assembly as defined in claim 1, in which:

(d) the core puller bars are of a length to be retained within the mold assembly when fully retracted.

6. A core puller assembly as defined in claim 1, in which:

(d) the core puller bars are aligned so that the remote end thereof is initially spaced vertically from the mold assembly when fully extended.

7. A core puller assembly as defined in claim 1, in which:

(d) at least one of the core puller units includes an adjustable stop disposed on the piston connector rod to predetermine the extent to which the associated core puller bar enters into the mold assembly.

8. A core puller assembly as defined in claim 1, in which:

(d) at least one of the core puller units includes a switch, having a switch actuator mounted to the associated core puller bar to preclude stripping of the mold assembly until the switch is closed.

9. A core puller unit for a block machine mold assembly, the core puller unit comprising:

(a) a cylinder having a forward end and a rearward end, (b) a piston mounted for sliding movement within the cylinder and having a rearwardly extending connecting rod, (c) a core puller bar disposed in side-by-side relation with the connecting rod, said bar including a radially offset from the axis of the forward portion cylinder, movable alongside the cylinder and into the mold assembly, and a rearward portion, (d) connecting means between the core puller bar and the connecting rod, and (e) guide means carried by the cylinder, said guide means receiving the core puller bar in sliding relation to guide said core puller into the mold assembly.

10. A core puller unit as defined in claim 9, in which:

(f) the guide means includes a front guide unit and a rear guide unit, said front guide unit having resilient means to permit relative transverse movement between the core bar and the cylinder.

11. A core puller unit as defined in claim 9, in which:

(f) the guide means includes a front guide unit and a rear guide unit, said front guide unit including a removable cartridge having resilient means to permit relative horizontal movement between the core bar and the cylinder.

12. A core puller unit as defined in claim 11, in which:

(g) the removable cartridge includes resilient means to permit relative vertical movement between the core bar and the cylinder.

13. A core puller unit as defined in claim 9, in which:

(f) the guide means includes a front guide unit and a rear guide unit, the front guide unit including a removable cartridge housing an insert apertured to receive the core bar in sliding relation and having at least one flexible element providing resilient means to permit relative transverse movement between the core bar and the cylinder and the rear guide unit including an insert apertured to receive the core bar in sliding relation.

14. A core puller unit as defined in claim 13, in which:

(g) the front guide unit insert includes opposed flexible side elements to permit relative horizontal movement and a lower flexible element to permit relative vertical movement.

15. A core puller unit as defined in claim 14, in which:

(h) the inserts are of plastic material.

16. A core puller unit as defined in claim 9, in which:

(f) the cylinder includes a front end stop having a socketed portion, and (g) the piston includes a reduced forward portion received by the cylinder socketed portion in cushioned relation.

17. A core puller unit as defined in claim 9, in which:

(f) the cylinder includes a pressurized air receiving port at the front end and the rear end, and (g) the piston includes a circumferentially disposed lubricating pad on its outer surface, and passage means between the lubrication pad and the front air receiving port providing pressurized air to the lubricating pad.

18. A core puller unit as defined in claim 9, in which:

(f) the cylinder includes:

1. a pressurized air receiving port at the front end and the rear end,
2. a front end stop having a reduced portion defining a chamber communicating with the front air port and a socketed portion, and 3. a rear end stop having a reduced portion, defining a chamber communicating with the rear air port and a socketed portion, (g) the piston includes:

1. a reduced forward portion received by the socketed portion of the front end stop,
2. a reduced rearward portion received by the socketed portion of the rear end stop,
3. an intermediate portion having an annular groove receiving a lubricating pad, and
4. passage means communicating between the lubrication pad and the front air receiving port providing pressurized air to the lubricating pad.

* * * * *